US007950910B2

(12) United States Patent
Miller et al.

(10) Patent No.: US 7,950,910 B2
(45) Date of Patent: May 31, 2011

(54) PISTON CARTRIDGE

(75) Inventors: Douglas Miller, New Berlin, WI (US); Michael Landrum, Rockford, IL (US); Donald E. Blackman, Tinley Park, IL (US); James M. Heim, Rockford, IL (US)

(73) Assignee: SPX Corporation, Charlotte, NC (US)

( * ) Notice: Subject to any disclaimer, the term of this patent is extended or adjusted under 35 U.S.C. 154(b) by 979 days.

(21) Appl. No.: 11/878,355

(22) Filed: Jul. 24, 2007

(65) Prior Publication Data

US 2008/0060513 A1 Mar. 13, 2008

Related U.S. Application Data

(60) Provisional application No. 60/843,701, filed on Sep. 12, 2006.

(51) Int. Cl.
*F04B 43/12* (2006.01)
*F04B 39/10* (2006.01)
*F16K 21/08* (2006.01)

(52) U.S. Cl. ..... 417/569; 417/470; 137/512.5; 137/512.1

(58) Field of Classification Search ..... 417/53, 417/470, 569; 137/512.5, 512.1
See application file for complete search history.

(56) References Cited

U.S. PATENT DOCUMENTS

| | | | | |
|---|---|---|---|---|
| 4,874,297 | A | 10/1989 | Collins et al. | |
| 5,440,878 | A | 8/1995 | Gleasman et al. | |
| 6,450,787 | B1 * | 9/2002 | Risch et al. | 417/569 |
| 6,863,502 | B2 | 3/2005 | Bishop et al. | |
| 7,367,788 | B2 * | 5/2008 | Kim | 417/470 |
| 2003/0206805 | A1 | 11/2003 | Bishop et al. | |
| 2004/0191099 | A1 * | 9/2004 | Moradmand et al. | 417/470 |
| 2005/0132879 | A1 | 6/2005 | Grollimund et al. | |
| 2005/0180855 | A1 | 8/2005 | Horiuchi et al. | |
| 2006/0090344 | A1 | 5/2006 | Suzuki et al. | |

FOREIGN PATENT DOCUMENTS

| | | | |
|---|---|---|---|
| DE | 19829124 | * | 8/1999 |
| GB | 557208 | | 11/1943 |

OTHER PUBLICATIONS

International Search Report dated Feb. 27, 2008.
International Search Report dated Mar. 24, 2008.

* cited by examiner

*Primary Examiner* — Charles G Freay
(74) *Attorney, Agent, or Firm* — Baker & Hostetler LLP

(57) ABSTRACT

A piston cartridge having a piston chamber, an inlet port, an outlet port, and a piston moveable between a first position and a second position. Also, the cartridge includes a first barrier positioned between the piston and the inlet port and a first sealing member moveable between the first barrier and the inlet port, wherein the first sealing member seals the inlet port when positioned adjacent to the inlet port but allows the fluid into the chamber when positioned adjacent to the first barrier. In addition, the cartridge also includes a second barrier positioned adjacent to the outlet port and a second sealing member moveable between the piston and the second barrier, wherein the second sealing member seals the outlet port when positioned adjacent thereto but allows the fluid to pass through the outlet port when positioned adjacent to the second barrier.

20 Claims, 10 Drawing Sheets

PISTON CARTRIDGE

CROSS-REFERENCE TO RELATED APPLICATIONS

This application claims benefit of U.S. Provisional Patent Application No. 60/843,701 titled, PRESSURE COMPENSATED PUMP, filed Sep. 12, 2006, which is hereby incorporated herein by reference in its entirety.

FIELD OF THE INVENTION

The present invention relates generally to fluid pumps. More particularly, the present invention relates to pumps capable of maintaining a constant horsepower output even as the pressure at which they operate fluctuates.

BACKGROUND OF THE INVENTION

Pumps that are capable of maintaining a constant horsepower output, even as the pressure at which they operate fluctuates, are currently available. These pumps are designed to use a given amount of horsepower inputted into them, generally through a motor, and to maximize the amount of horsepower that they output, regardless of the pressure at which they operate. Thus, such pumps operate more efficiently than other pumps that are not capable of maintaining a constant horsepower output.

Typically, pumps that are capable of maintaining a constant horsepower output are operable in relatively low pressure ranges. On the other hand, pumps that are operable in higher pressure ranges are unable to maintain a constant horsepower output as the operating pressure of the pump changes. Typically, such higher pressure pumps are multi-stage pumps and are essentially made up of multiple pumps that are linked together using a mechanism for switching between the multiple pumps.

Accordingly, it would be desirable to provide novel pumps and methods that are capable of maintaining a constant horsepower output even at high pressures. It would also be desirable to provide novel pumps that consist of infinite stages (i.e., that are truly single pumps).

In addition to the above, it would also be desirable to provide pumps that are modular and therefore easily, and cost-effectively repairable. Further, it would be desirable to provide pumps that maximize efficiency by minimizing the total volume of the piston chambers included therein.

SUMMARY OF THE INVENTION

The foregoing needs are met, to a great extent, by the present invention, wherein in one embodiment thereof, a piston cartridge is provided. The piston cartridge includes a piston chamber. The piston cartridge also includes an inlet port positioned adjacent to the piston chamber and providing a pathway through which a fluid may enter the piston chamber. The piston cartridge further includes a first outlet port positioned adjacent to the piston chamber and providing a pathway though which the fluid may exit the piston chamber. In addition, the piston cartridge also includes a piston at least partially positioned within the piston chamber and moveable between a first position that is relatively close to the inlet port and a second position that is relatively far from the inlet port. Also, the piston cartridge includes a first barrier positioned between the piston and the inlet port. Further, the piston cartridge includes a first sealing member positioned and moveable between the first barrier and the inlet port, wherein the first sealing member substantially seals the inlet port when positioned adjacent to the inlet port but allows the fluid into the piston chamber when positioned adjacent to the first barrier. In addition, the piston cartridge also includes a second barrier positioned adjacent to the first outlet port. The piston cartridge also includes a second sealing member positioned and moveable between the piston and the second barrier, wherein the second sealing member substantially seals the first outlet port when positioned adjacent thereto but allows the fluid to pass through the first outlet port when positioned adjacent to the second barrier.

According to another embodiment of the present invention, a method of operating a piston is provided. The method includes moving a piston within a piston chamber from a first position that is relatively close to an inlet port of the piston chamber to a second position that is relatively far from the inlet port. The method also includes allowing a fluid to flow into the piston chamber upon moving the piston from the first position to the second position by allowing a first sealing member configured to seal the inlet port when positioned adjacent thereto to move away from the inlet port. The method further includes preventing the fluid from flowing out of the piston chamber upon moving the piston from the first position to the second position by allowing a second sealing member to move toward an outlet port and thereby form a seal therewith.

According to yet another embodiment of the present invention, another piston cartridge is provided. The piston cartridge includes fluid accommodating means for accommodating a fluid and fluid inletting means for inletting the fluid into the fluid accommodating means, wherein the fluid inletting means is positioned adjacent to the fluid accommodating means and provides a pathway through which the fluid may enter the fluid accommodating means. The piston cartridge also includes fluid outletting means for outletting the fluid from the fluid accommodating means, wherein the fluid outletting means is positioned adjacent to the fluid accommodating means and providing a pathway though which the fluid may exit the fluid accommodating means and fluid moving means for moving the fluid, wherein the fluid moving means is at least partially positioned within the fluid accommodating means and moveable between a first position that is relatively close to the fluid inletting means and a second position that is relatively far from the fluid inletting means. In addition, the piston cartridge also includes first barrier means for providing a first barrier, the first barrier means positioned between the fluid moving means and the fluid inletting means and first sealing means for providing a first fluid seal, the first sealing means positioned and moveable between the first barrier means and the fluid inletting means, wherein the first sealing means substantially seals the fluid inletting means when positioned adjacent to the fluid inletting means but allows the fluid into the fluid accommodating means when positioned adjacent to the first barrier means. The piston cartridge also includes second barrier means for providing a second barrier, the second barrier means positioned adjacent to the fluid outletting means and second sealing means positioned and moveable between the fluid moving means and the second barrier means, wherein the second sealing means substantially seals the fluid outletting means when positioned adjacent thereto but allows the fluid to pass through the fluid outletting means when positioned adjacent to the second barrier means.

According to still another embodiment of the present invention, another method of operating a pump is provided. The method includes rotating an eccentrically shaped cam about a first axis. The method also includes translating the cam along the first axis. The method further includes maintaining a position along the first axis of a bearing that is adjacent to the cam as the cam translates along the first axis. In addition, the method also includes pushing a piston positioned adjacent to the bearing with the bearing as the cam rotates. The method further includes maintaining a substantially constant power output level from the pump as the cam translates along the first axis.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
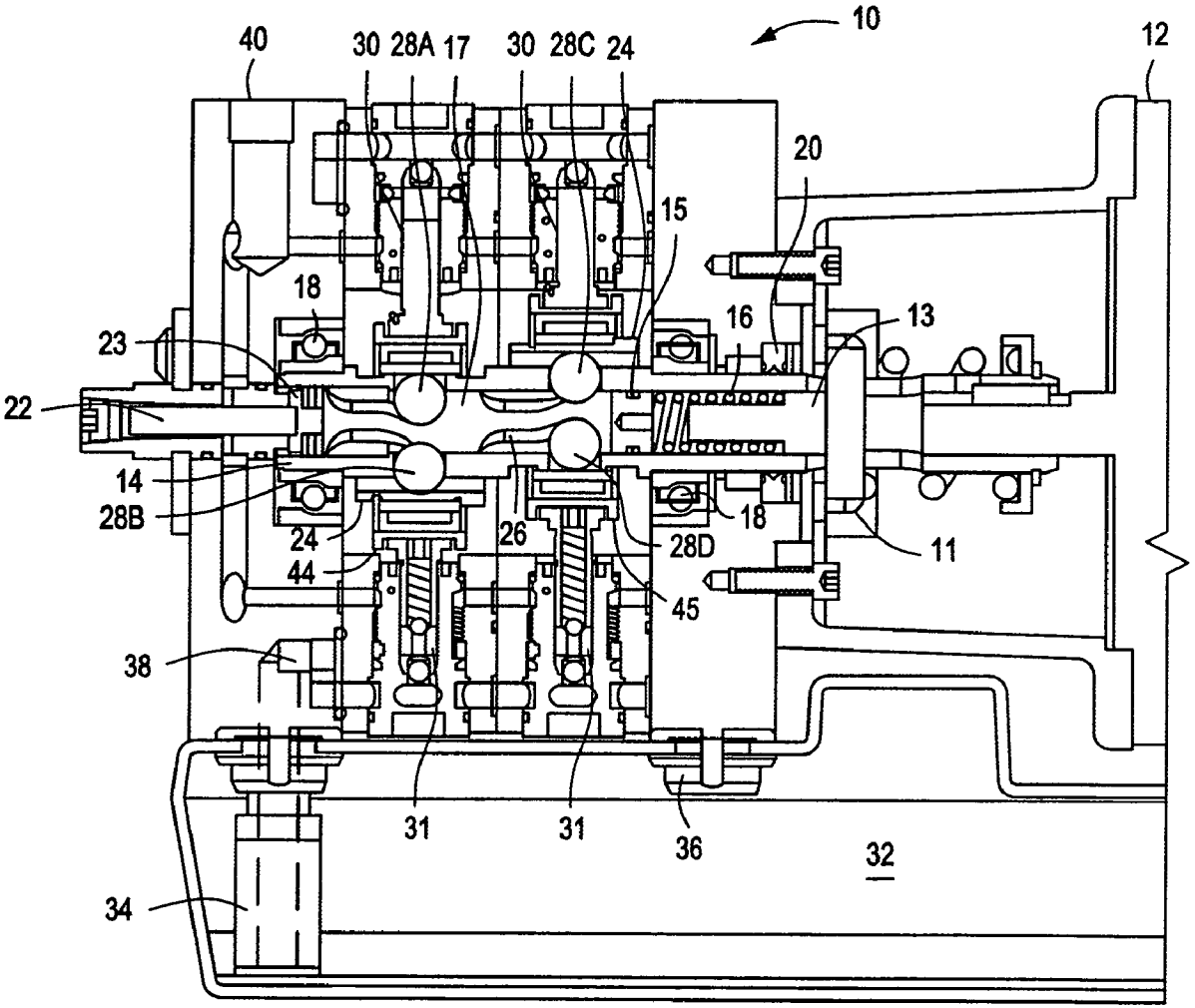
FIG. 1 illustrates a cross-section of a pump according to a first embodiment of the present invention.

The invention will now be described with reference to the drawing figures, in which like reference numerals refer to like parts throughout. FIG. 1 illustrates a cross-section of a pump 10 according to a first embodiment of the present invention. As illustrated in FIG. 1, the pump 10 has a radial design (as opposed to an axial design) and includes a motor 12 that is connected to a pump shaft 14. The pump shaft 14 houses a spring assembly 16 having a first end that is adjacent to the motor 12 and a second end that is adjacent to a cam 17.

According to certain embodiments of the present invention, the spring assembly 16 includes a stack of two, three, or more springs. When three springs are use, a heavy spring (i.e., a spring with a high spring constant and capable of exerting a large spring force when compressed) is typically positioned furthest to the right in the spring assembly 16 illustrated in FIG. 1. Then, a medium spring is positioned in the middle of the spring assembly 16 and a light spring is positioned next to the cam 17. Together, the three springs form the progressive spring assembly 16 that, as will be explained below, will be used to position the cam 17 relative to other components in the pump 10. According to certain embodiments of the present invention, each spring in the plurality of springs in the spring assembly 16 has a different spring rates/force. However, configurations where two or more springs have the same spring rate/force are also within the scope of the present invention.

In FIG. 1, the spring assembly 16 is positioned about an internal spring guide 13. The internal spring guide 13 is concentrically located inside the shaft 14, abuts the pin 11, and maintains the spring assembly 16 substantially in the center of the shaft 14. Positioned at the end of the spring assembly 16 closest to the cam 17 is a cam seal plug 15 designed to prevent liquid that is lubricating the cam 17 from leaking onto the spring assembly 16.

In operation, the motor 12 is mechanically connected to the pump shaft 14 and cam 17 and causes both to rotate. According to certain embodiments of the present invention, the cam 17 is rotated at between about 3,000 and about 4,000 rpm. However, other rpm ranges are also within the scope of the present invention.

As illustrated in FIG. 1, the pump shaft 14 is supported by a pair of shaft bearings 18. A shaft seal assembly 20 is positioned around the pump shaft 14 and near the end that is adjacent to the motor 12. Also positioned around the pump shaft 14 is a pair of saddles 24 that are generally used to keep other components of the pump 10 in position, as will become apparent pursuant to reviewing the accompanying figures.

Positioned adjacent to the end of the cam 17 that is located opposite the spring assembly 16 is a pilot piston 22 that effectively acts as an actuator for moving the cam 17 along a longitudinal axis, A, of the pump shaft 14. According to certain embodiments of the present invention, a substantially spherical object (e.g., a ball) or a thrust bearing assembly such as element 23 in FIG. 1 is positioned between the pilot piston 22 and the cam 17 to facilitate the axial spinning of the cam 17 relative to the pilot piston 22. The substantially spherical object or thrust bearing assembly 23 is typically capable of spinning as the cam 17 rotates.

According to certain other embodiments of the present invention, the pilot piston 22 is a small rod that extends along the longitudinal axis, A, of the pump shaft 14 and comes to a point that is positioned against the cam 17. According to such embodiments, the pilot piston 22 provides a single-point contact against the cam 17 and there is, therefore, no associated torque arm. As such, the cam 17 may spin at a relatively high rpm and a rotary seal is not necessary. The same is true of embodiments of the present invention where the single-point contact is replaced with the thrust bearing assembly 23 or substantially spherical object.

The cam 17 has a plurality of grooves 26 formed therein and, as illustrated in FIG. 1, is resultantly indented and is typically eccentric about the cam's longitudinal axis, A (which is also the longitudinal axis of the pump shaft 14 in FIG. 1). Received in each of the grooves 26 illustrated in FIG. 1 is a sphere 28A, 28B, 28C, 28D. Each of the spheres 28A, 28B, 28C, 28D illustrated in FIG. 1 is positioned between a piston 30 and a lube piston 31 and in the same plane as the central axes of the pistons 30, 31. Typically, the lube piston 31 allows a lubricant to be introduced into the interior of the pump shaft 14 and the piston 30 is configured to act as a fluid displacement mechanism (discussed below). According to certain embodiments of the present invention, in operation, the eccentrically-shaped cam 17, the spheres 28A, 28B, 28C, 28D, and the pump shaft 14 are all rotated about the longitudinal axis, A, of the pump shaft 14 by the motor 12 in bearing rings 44 and 45 illustrated in FIG. 2, which in combination act as an eccentric.

In FIG. 1, spheres 28A and 28B are vertically aligned with each other and make up a first pairs of spheres while spheres 28C and 28D also are vertically aligned with each other and make up a second pair of spheres. Each sphere pair is also aligned vertically with one of the pistons 30 and one of the lube pistons 31 illustrated in FIG. 1. In each pair of spheres, one sphere (e.g., 28A and 28D) is positioned relatively close to the longitudinal axis, A, of the pump shaft 14 while the other sphere in the pair of spheres (e.g., 28B and 28C) is positioned relatively far from the same axis. Upon rotation of the cam 17 and spheres 28A, 28B, 28C, 28D, saddles 24, and bearing rings 44 and 45 about the longitudinal axis, A, which creates an eccentric, each of the spheres 28A, 28B, 28C, 28D will affect the displacement position of the eccentric which will come into contact with the pistons 30 and lube pistons 31.

Upon contact of the eccentric with one of the pistons 30 and lube pistons 31, the spheres 28B, 28C that are relatively far from the longitudinal axis, A, of the pump shaft 14 will push the eccentric and one of the pistons 30 or lube pistons 31 outward and the spheres 28A, 28D that are relatively near the longitudinal axis, A, will allow the other piston 30 and lube piston 31 to travel back inward towards the longitudinal axis, A. The total distance that the pistons 30 travel upon one complete rotation of the eccentric and cam 17 (i.e., the piston stroke) determines how much fluid is capable of flowing through the pump 10. Generally, the greater the distance that the piston 30 travels, the more fluid will flow through the pump 10.

The pump 10 illustrated in FIG. 1 also includes a tank 32 (i.e., an oil reservoir), a suction filter 34, a return tube 36, an input oil groove 38 from the tank 32, and a pump output port 40 that accommodates the flow of high-pressure oil from the pump 10. In operation, oil flows from the tank 32, through the suction filter 34, through the input oil groove 38, and into piston chambers (e.g., pumping chamber 62 illustrated in FIG. 6) that are adjacent to the pistons 30 illustrated in FIG. 1. The pistons 30 then apply pressure to the oil in the piston chambers and the oil is released through the pump output port 40. However, other pump configurations are also within the scope of the present invention.

Figure 2:
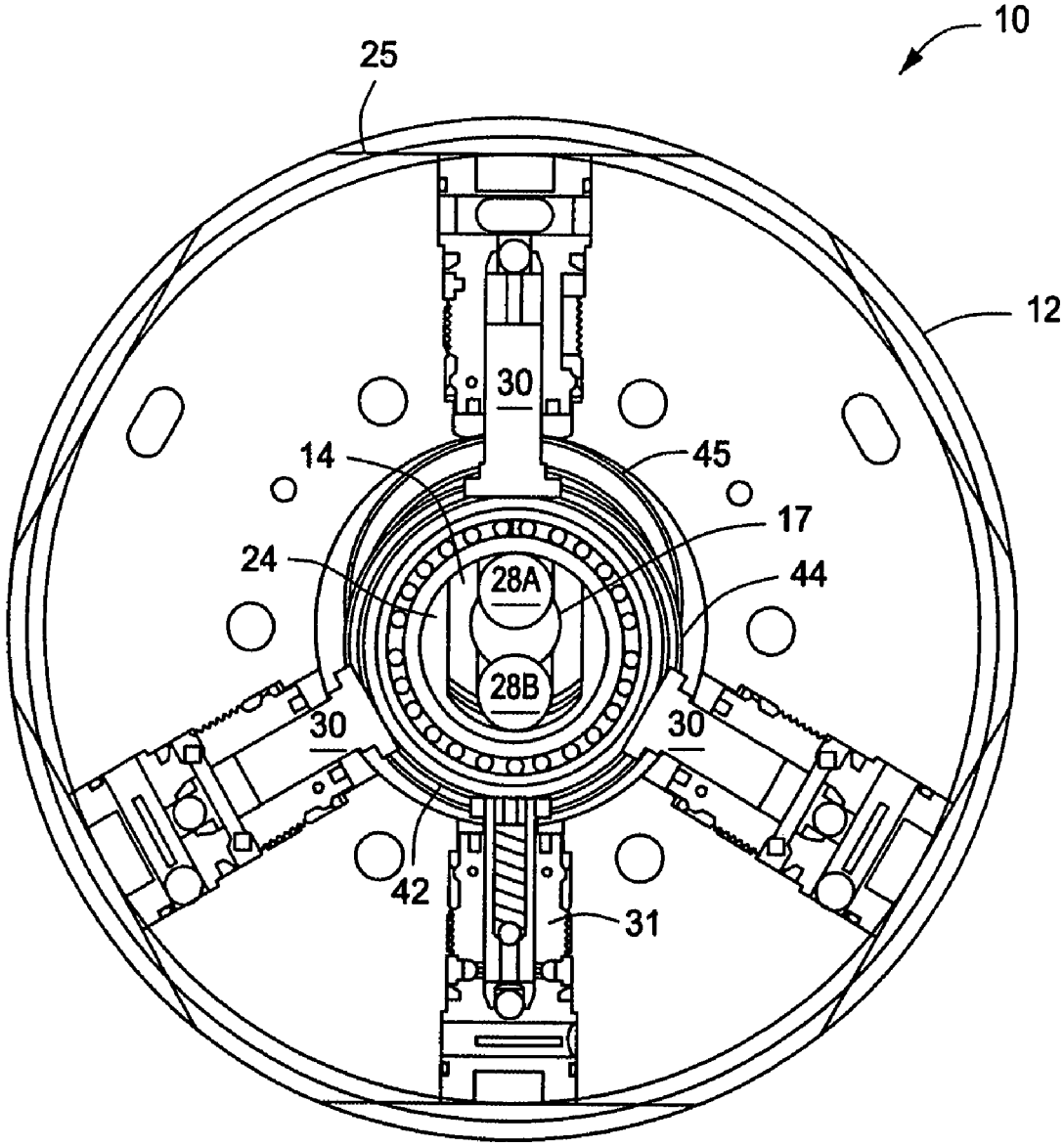
FIG. 2 illustrates a perspective view of a cross-section of an interior portion of the pump illustrated in FIG. 1.

FIG. 2 illustrates a perspective view of a cross-section of an interior portion of the pump 10 illustrated in FIG. 1. The cross-section illustrated in FIG. 2 is perpendicular to the cross-section illustrated in FIG. 1. The front face of FIG. 2 also coincides with the cross-section of a pump ring sub-assembly 25. As illustrated in FIG. 2, the two spheres 28A, 28B on either side of the cam 17 are positioned adjacent to the saddle 24 and a bearing ring 42. The outside of the bearing ring 42 is adjacent to one of the two eccentrics 44, 45 illustrated in FIG. 2. A forward eccentric 44 is illustrated as being positioned at the proximate end of the cross-section and a rear eccentric 45 is positioned behind the forward eccentric 44 (i.e., closer to the motor 12).

As will be discussed below, the pump 10 is a pressure compensated pump that, upon appropriate positioning of the cam 17 relative to the pump shaft 14 and pistons 30, is capable of delivering variable fluid flow as a function of and at any pressure at which the pump 10 is operated. According to certain embodiments of the present invention, and as will also be discussed below, the pump 10 is configured to optimize its own output performance by monitoring the pressure at which it is operating and by using that pressure value to control its own operation.

By definition, in order to determine the horsepower of a pump, the fluid flow (e.g., gallons/minute) out of the pump is first multiplied by the pressure at which the pump is operating and that calculated value is then divided by a constant. When using, for example, a 1.5 horsepower motor as the motor 12 to drive the pump 10, it is typically preferable to operate the pump 10 at as close to the rated horsepower level to optimize performance. It is also typically preferable to be able to maintain the approximate rated horsepower level of operation of the pump, even when the pump's operating pressure fluctuates.

Currently, there is a market demand for pumps that are capable of maintaining a constant horsepower output of up to the 10,000 psi range and beyond, even as the pressure at which they operate fluctuates (i.e., there is a need for pressure compensation pumps that operate at relatively high pressures). However, currently available pressure compensation pumps, at best, only operate in ranges up to between 2,000 and 5,000 psi. Also, even at these relatively low pressures, currently available pressure compensation pumps are complex, expensive, and cumbersome mechanisms.

Currently available pumps that do operate in the 10,000+ psi range are multi-stage pumps and, therefore, do not provide continuous pressure compensation. Rather, these multi-stage pumps experience a step down in output power every time the rising operating pressure of the pump forces a switch or transition to a new stage. In other words, these pumps are relatively inefficient compared to pressure compensation pumps. In addition, the step-down mechanisms used in such pumps include either complex, expensive, and cumbersome moving swash plates and/or valving plates or unloading valves for each stage.

According to certain embodiments of the present invention, the pump 10 is an infinitely variable single-stage pressure compensation pump (i.e., with infinite stages) that can operate anywhere from approximately 1 psi to approximately 10,000 psi and beyond. As has been illustrated in FIGS. 1 and 2, the components of the pump 10 are designed to be relatively simple and, as will be discussed below, operation of the pump 10 is relatively efficient.

Figure 3:
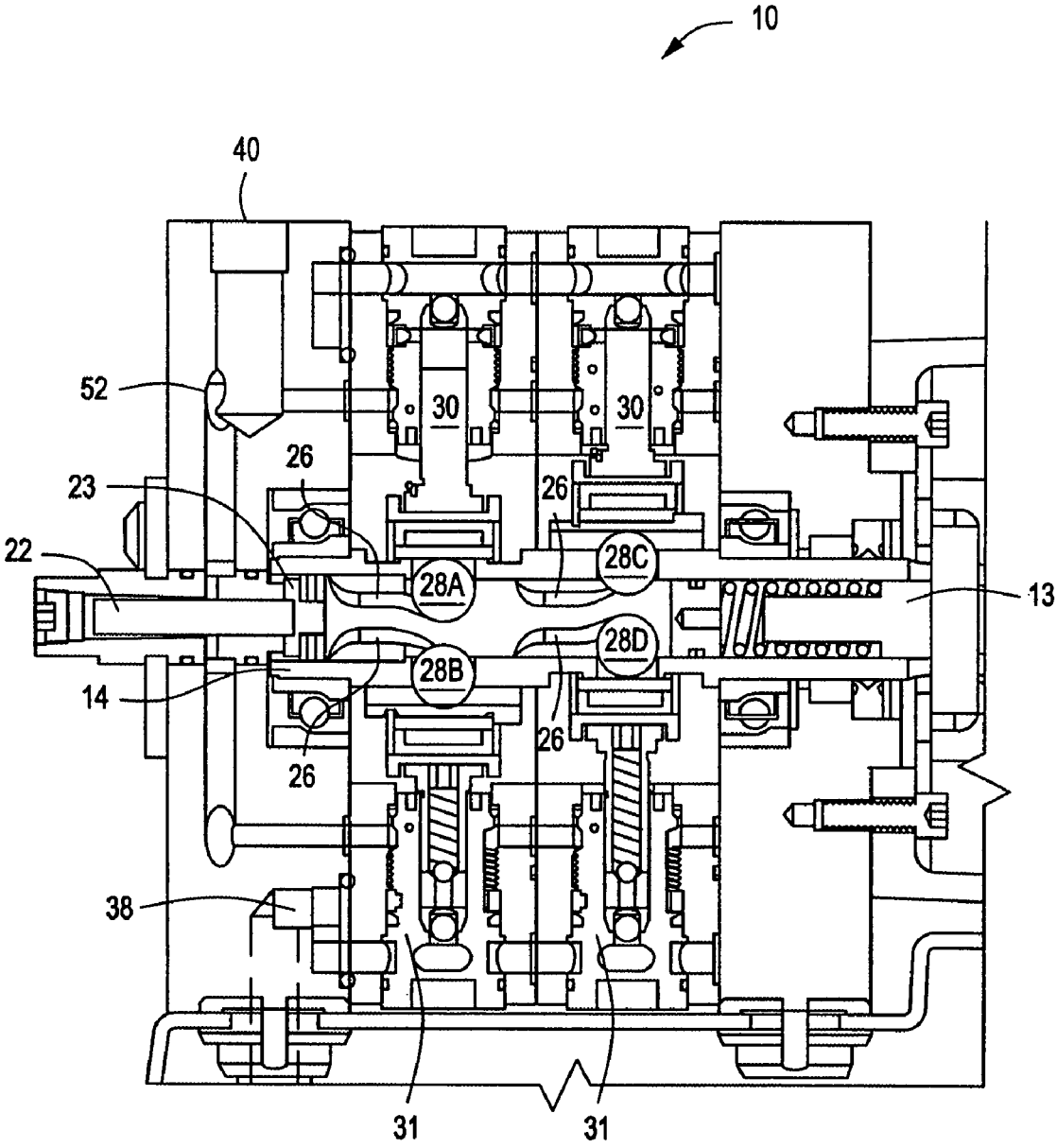
FIG. 3 illustrates a portion of the cross-section of the pump illustrated in FIG. 1 wherein the cam shaft is in a fully stroked position.
Figure 4:
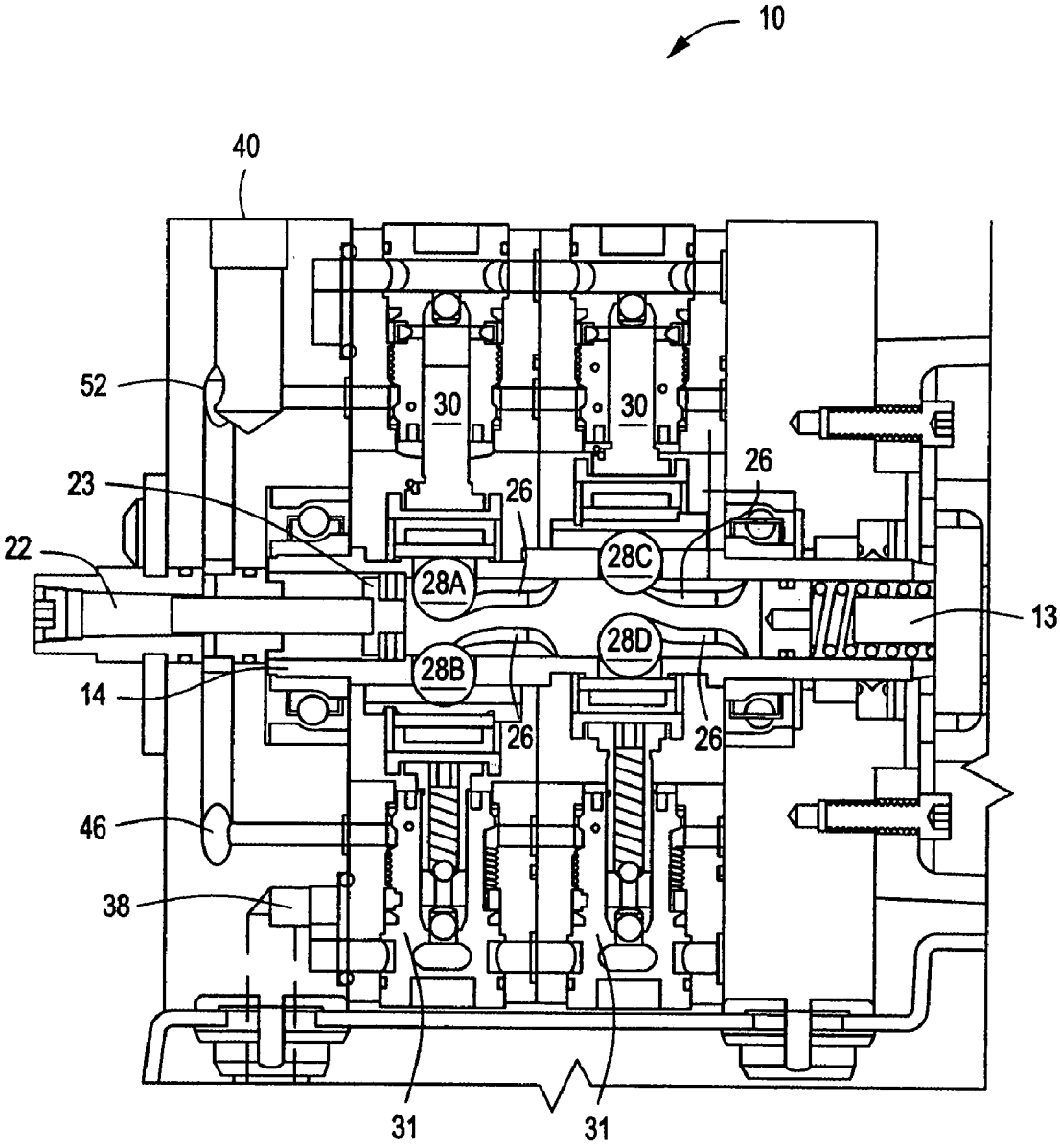
FIG. 4 illustrates a portion of the cross-section of the pump illustrated in FIG. 1 wherein the cam shaft is in a fully destroked position.

FIG. 3 illustrates a portion of the cross-section of the pump 10 illustrated in FIG. 1 wherein the cam shaft 17 is in a fully stroked position (i.e., in a position where the spheres 28B and 28C that are closest to the pistons 30 sit in the shallowest portions of the grooves 26). FIG. 4 illustrates a portion of the cross-section of the pump 10 illustrated in FIG. 1 wherein the cam shaft 17 is in a fully destroked position (i.e., in a position where the spheres 28B, 28C that are closest to the pistons 30 sit in the deepest portions of the grooves 26). FIG. 4 also illustrates a pilot pressure port 46 that is connected to high pressure passages of the pump 10. According to certain embodiments of the present invention, this pressure is used to control the position of the pilot piston 22.

As will be appreciated by one of skill in the art upon practicing certain embodiments of the present invention, when the cam 17 is positioned as illustrated in FIG. 3 and is rotated by the motor 12 (illustrated in FIG. 1), the pistons 30 experience the maximum degree of travel allowable by the pump 10 and provide the most flow to maintain a given horsepower. On the other hand, when the cam 17 is positioned as illustrated in FIG. 4, the pistons 30 experience the minimum degree of travel that still allows the pump 10 to operate as intended. Adjustment of the position of the cam 17, discussed below, will allow the pump 10 to provide the desired maximum horsepower at the operating pressure of the pump 10.

Figure 5:
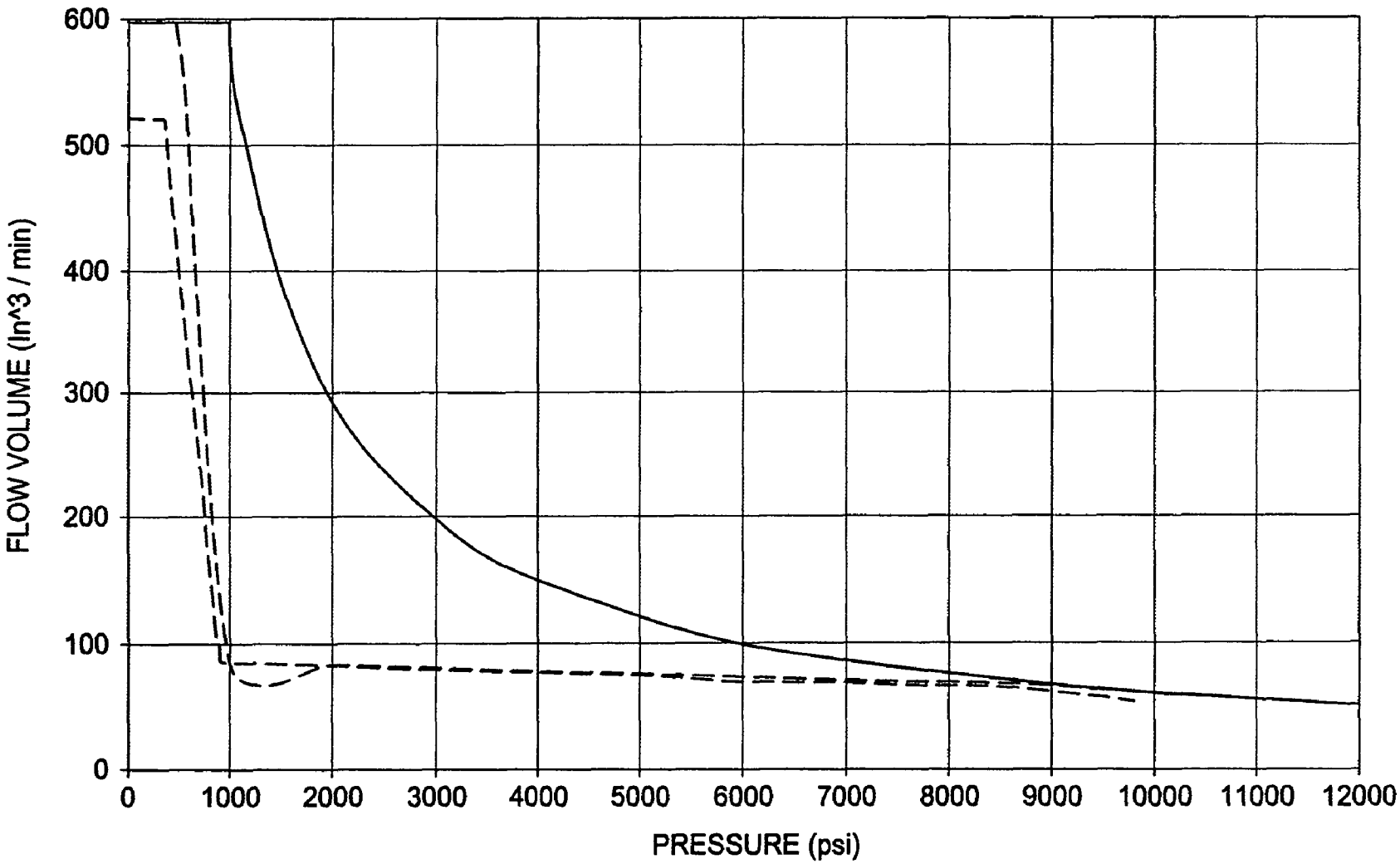
FIG. 5 illustrates three representative horsepower curves for the pump illustrated in FIGS. 1-4.

FIG. 5 illustrates three representative horsepower curves. The solid curve is based on theoretical horsepower data while the two dashed curves are based on measured data of two typical two-stage pumps that do not follow the horsepower curve. According to certain embodiments of the present invention, the profile of the cam 17 (i.e., the curvature of the grooves 26), along with the design of the spring assembly 16 (i.e., the relative forces exerted by the springs included in the spring assembly 16 upon compression) and the relationship of the pilot piston force, keep the pump 10 operating along the theoretical horsepower curves illustrated in FIG. 5. As noted above, although theoretical values may be used, the shape of the horsepower curve is typically determined via empirical studies. The formula that defines a horsepower curve is an exponential function and is generated using hundreds of data points taken at different operating pressures and flow volumes of the pump 10 that maximize the horsepower output of the pump 10.

According to certain embodiments of the present invention, the horsepower curve is smoothed so as to be continuous. This allows for the grooves 26 in the cam 17 to also be smooth and continuous. When the pump 10 is in operation, the pilot piston 22 exerts a force upon the cam 17 that is typically either equal to or a function of the pressure at which the pump 10 itself is operating. According to certain embodiments of the present invention, a closed feedback loop signal is used to control the pilot piston 22 (discussed below). According to other embodiments of the present invention, a manual or automated interface could be provided to control the pilot piston 22. Also, other means of controlling the pilot piston 22 that will become apparent to one of skill in the art upon practicing the present invention are also within the scope of the present invention.

Regardless of how it is controlled, the force exerted, either directly or indirectly, onto the cam 17 by the pilot piston 22 positions the cam 17 at a location relative to the pistons 30 that is substantially optimal for the operating pressure of the pump 10. In other words, the cam 17 is positioned so that the spheres 28A, 28B, 28C, 28D cause the pistons 30 to travel distances that provide a flow rate for the pump 10 that substantially optimizes the rated horsepower of the pump 10 at that operating pressure.

Returning to the discussion of FIGS. 3 and 4, in the fully stroked position illustrated in FIG. 3, the pump 10 delivers a relatively high flow rate at a relatively low pressure (e.g., only a few psi). In the fully destroked position illustrated in FIG. 4, the pump delivers a relatively low flow at a relatively high pressure (e.g., between 6,000 and 10,000 psi or more). According to certain embodiments of the present invention, the pilot piston 22 may be used to position the cam 17 at any location between the fully stroked and fully destroked positions. As such, all flow rates and associated pressures that substantially maximize the horsepower of the pump 10 are available. In other words, the pump 10 is an infinitely positionable pressure compensated pump that operates with the movement of very few components.

According to certain embodiments of the present invention, each piston 30 that is positioned about the forward eccentric 44 illustrated in FIG. 2 has a corresponding sister piston 30 that is positioned about the rear eccentric 45 about the longitudinal axis, A, of the pump shaft 14. However, other shapes are also possible and are contemplated within the present invention. For example, according to an embodiment of the present invention where five pistons 30 are included, the five pistons may make a star or pentagon shape (i.e., the pistons may be offset by 72 degrees from each other).

According to certain embodiments of the present invention, the resultant vector of the set of pistons in each eccentric 44, 45 is 180° out-of-phase with the resultant vector of the set of pistons in the other eccentric 44, 45. This feature keeps the eccentrics 44, 45 illustrated in FIG. 2 from torquing the cam 17 and therefore at least substantially eliminates the need to provide counter-balances in the pump 10. In turn, this method of operation reduces the overall cost and complexity of the pump 10.

Although only two eccentrics 44, 45 are illustrated in FIG. 2, according to other embodiments of the present invention, three or more eccentrics may be used. When, for example, three eccentrics are included in the pump 10, each piston has two sister pistons that are operating in phase with the piston 30 and each sister piston is offset by 120 degrees about the longitudinal axis, A, of the pump shaft 14. Similarly, when, for example, four eccentrics are included, each piston 30 has three in-phase sister pistons. Thus, according to certain embodiments of the present invention, the forces exerted on the cam 17 by a first piston are substantially always balanced by forces exerted on the cam 17 by one or more offset, in-phase, sister pistons.

According to other embodiments of the present invention, methods of operating a pump are provided. According to some of these embodiments, a pump (e.g., the above-discussed pump 10) is operated at a first pressure level (e.g., approximately 1,000 psi). The same pump is also operated at a first power output level that, for example, may be selected to at least substantially coincide with the power level of a motor that drives the pump (e.g., approximately 1.5 horsepower according to certain embodiments of the present invention).

Then, the first pressure level at which the pump is operated at is transitioned to a second pressure level. This second pressure level, according to certain embodiments of the present invention, is above approximately 6,000 psi or is above approximately 10,000 psi in other embodiments or even higher according to other embodiments.

During transitioning of the operating pressure level of the pump from the first pressure level to the second pressure level (or even to other levels), certain embodiments of the present invention substantially maintain the first power output level. One exemplary way to implement maintaining the first power output level includes allowing the pilot piston 22 to move along the longitudinal axis, A, as the pump pressure increases and decreases. According to such embodiments, the cam 17 is displaced to various locations along the longitudinal axis, A, by the pilot piston 22.

As discussed above, according to certain embodiments of the present invention, the spring assembly 16 and the pilot piston 22 are specifically designed to move the spheres 28A, 28B, 28C, 28D in the grooves 26 of the cam 17 illustrated in FIG. 1 as the operating pressure of the pump 10 changes. More specifically, the spheres 28A, 28B, 28C, 28D are moved in the grooves 26 such that, as the spheres 28A, 28B, 28C, 28D spin about the longitudinal axis, A, the pistons 30 will be displaced distances that will maintain the rated power output level of the pump 10. As such, the above-discussed substantially maintaining the first power output level of the pump may be implemented using the components illustrated in FIG. 1.

The above-discussed method also may include minimizing vibrations in the pump by providing counterbalanced fluid displacement mechanisms. According to certain embodiments of the present invention, this step may be implemented by offsetting the positions of the pistons 30 in the pump 10 as illustrated in FIG. 2 and by operating the pistons 30 out of phase with each other to offset each piston's force on the cam 17.

Figure 6:
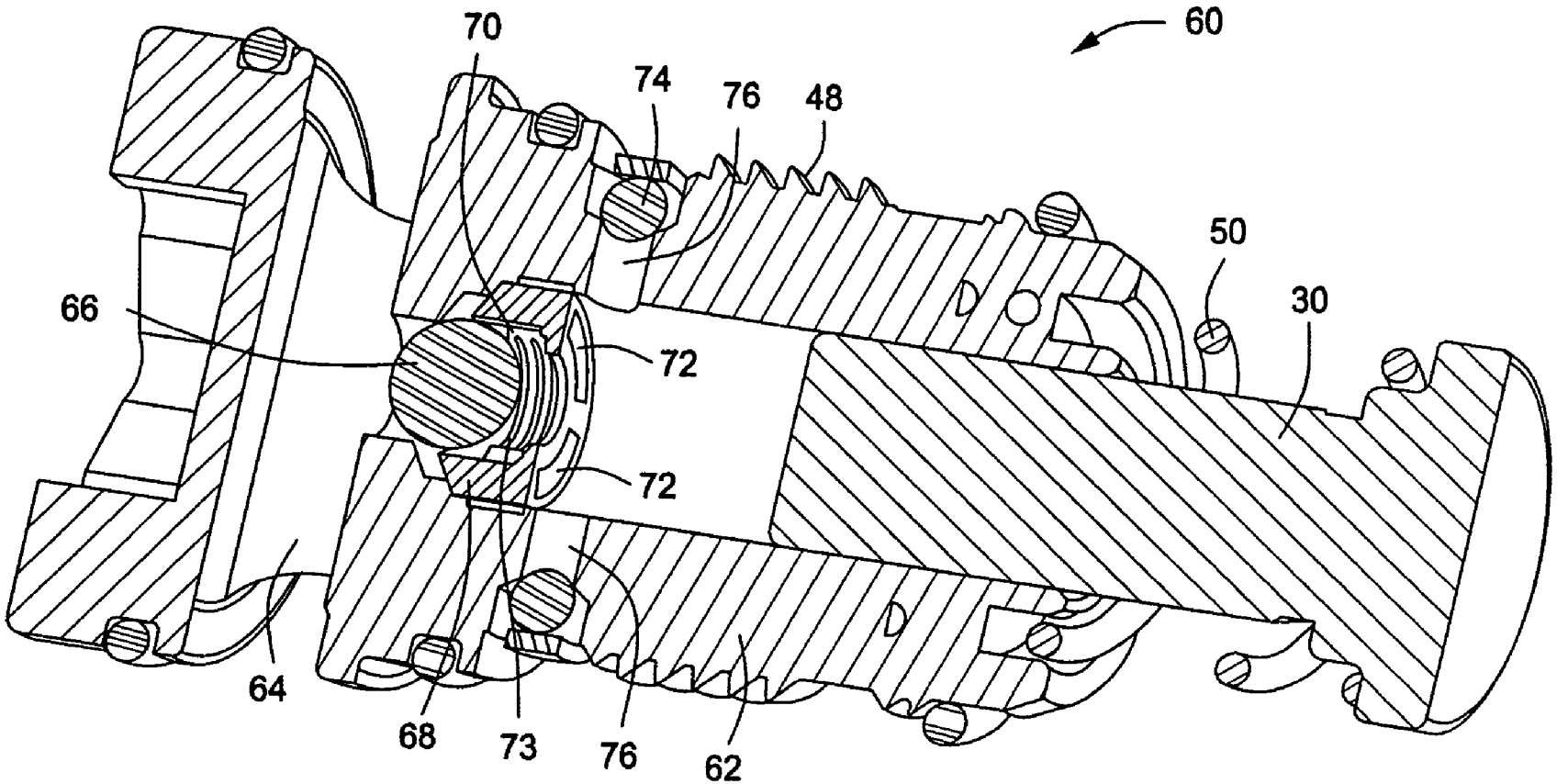
FIG. 6 illustrates a cross-section of a piston cartridge according to yet another embodiment of the present invention.

FIG. 6 illustrates a cross-section of a piston cartridge 60 according to yet another embodiment of the present invention. The piston cartridge 60 includes one of the above-discussed pistons 30 in a pumping chamber 62. At the top and bottom of the cross-section of the cartridge 60 illustrated in FIG. 6 are oil input ports 64. Also illustrated in FIG. 6 and positioned to the right of the input ports 64 is an inlet check ball 66 and a check ball guide 68. At the sides of the pumping chamber 62 are oil output ports 76 that have output check balls 74 positioned adjacent thereto. The cartridge 60 also includes buttress threads 48 on the outside thereof and a piston return spring 50 that extends between the piston 30 and one end of the piston cartridge 60.

The piston cartridge 60 illustrated in FIG. 6 is a self-contained pumping element that may be used not only in conjunction with the pump 10 illustrated in FIG. 1 but also in conjunction with other pumps and devices. The types of other pumps and devices in which the piston cartridge 60 may be used will become apparent to one of skill in the art upon practicing one or more embodiments of the present invention.

As illustrated in FIG. 6, the piston 30 is positioned in the center of the piston cartridge 60. More specifically, the piston 30 is in the pumping chamber 62 and functions as a pumping piston that pumps oil in the pump 10. As discussed above, the piston 30 moves as it contacts one or more of the eccentrics illustrated in FIGS. 1-4. However, a conventional (i.e., fixed displacement) cam shaft or other element may also be used to move the piston 30.

As the piston 30 illustrated in FIG. 6 moves to the right, the suction check ball 66 is drawn toward the piston 30 by the suction created by the motion of the piston 30. The piston 30 also draws oil through the input ports 64, around the suction check ball 66, and into the pumping chamber 62. When oil is drawn into the pumping chamber 62 as discussed above, the output check balls 74 illustrated in FIG. 6 prevent oil from flowing through output ports 76 because the output check balls 74 are drawn inward by the piston suction and held in place by a C-spring 78 (illustrated in FIG. 7) biased towards the seats.

Immediately to the right of the check ball 66 is the check ball guide 68, which receives the check ball 66 and may be made of any material but which is often made of a plastic. The ball guide 68 includes a plurality of lobes 70 (i.e., protrusions) that guide the check ball 66 centrally relative to the check ball guide 68. The ball guide 68 also includes a plurality of grooves 72 that allow oil to pass from the input ports 64 and into the pumping chamber 62.

As illustrated in FIG. 6, also included in the piston cartridge 60 is a spring 73 that is positioned between the check ball 66 and the check ball guide 68. This spring 73 biases the check ball 66 toward the input ports 64, and when the piston 30 is not creating suction pressure, the check ball 66 is positioned against the input ports 64 and prevents oil from flowing therethrough.

When the piston 30 moves to the left in FIG. 6, the input ports 64 are at least substantially sealed off by the suction check ball 66. Also, the output check balls 74 are pushed away from the piston 30 and oil is pushed through the output ports 76 located on the sides of the pumping chamber 62.

Figure 7:
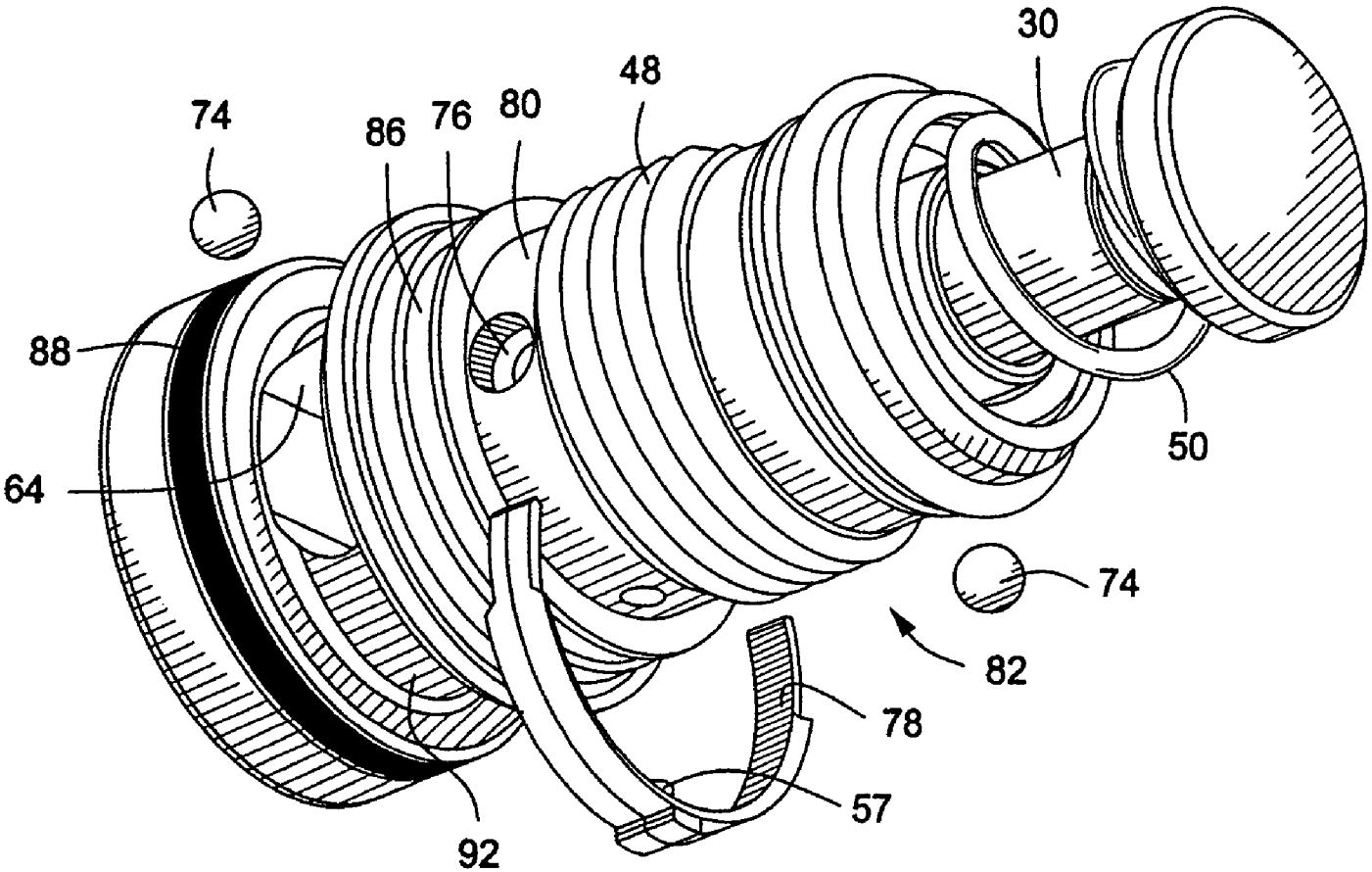
FIG. 7 is a peripheral view of the piston cartridge illustrated in FIG. 6.

FIG. 7 is a peripheral view of the piston cartridge 60 illustrated in FIG. 6. As illustrated in FIG. 7, a low-pressure oil input groove 92 directs fluid to the input ports 64. Also, a C-spring 78 wraps around a high pressure oil output groove 80 on the outside of the piston cartridge 60 and extends over the output ports 76. As such, the C-spring 78 prevents the output check balls 74 from moving away from the cartridge 60 entirely while the piston 30 is moving to the right in FIG. 6. It should also be note that, according to certain embodiments of the present invention, a tab or other protrusion 57 is located on an inner surface of the C-spring 78. This protrusion 57 is typically inserted into a retaining notch 59 formed in the high-pressure oil output groove 80 and prevents the C-spring 78 from rotating about the cartridge 60.

Also illustrated in FIG. 7 is a threaded region 82 that typically includes threads (e.g., the buttress threads 48 illustrated in FIG. 6) that allow for the cartridge 60 to be screwed into a pump or other device and to thereby fix the location of the cartridge 60. Of course, other coupling methods can also be used (e.g., a coupling assembly). The earlier-discussed piston return spring 50 is illustrated in FIG. 7 and pushes against the piston 30. This spring 50 restores the piston 30 to a location to the right-hand-side of FIG. 7 when not counteracted by other forces. In addition, a pair of high-pressure O-ring seals 86 and an individual low-pressure O-ring 88 are illustrated in FIG. 7. The pair of O-ring seals 86 are designed to prevent oil leakage of the cartridge 60.

Figure 8:
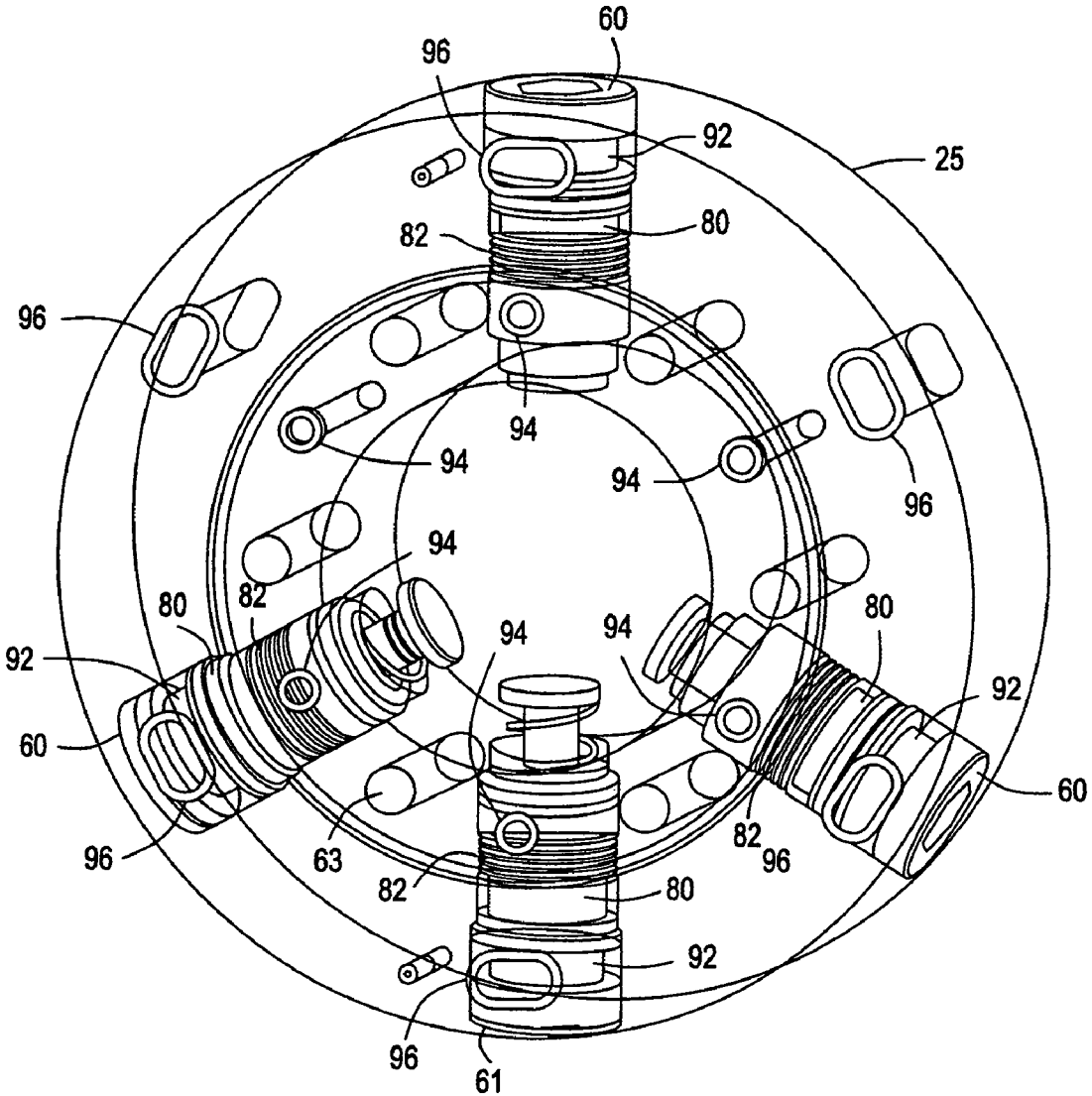
FIG. 8 illustrates a semi-transparent perspective view of the pump ring sub-assembly illustrated in FIG. 2 that includes three cartridges and one lube cartridge.

FIG. 8 illustrates a semi-transparent perspective view of the pump ring sub-assembly 25 illustrated in FIG. 2 that includes three cartridges 60 such as the one illustrated in FIG. 7 and one lube cartridge 61 that houses the above-discussed lube piston 31. The ring sub-assemble 25 also illustrates bolt holes 63 that allow for the insertion of bolts through the ring sub-assembly 25 in order to attach the ring sub-assembly 25 to other components of the above-discussed pump 10.

When oil is pumped out of the cartridge 60, the oil flows into the a high-pressure oil output groove 80. Also, it should be noted that there are low-pressure input oil passage 96 illustrated in FIG. 8 that allow oil to travel from the tank 32 (see FIG. 1) to the input grooves 92 of the cartridges.

Figure 9:
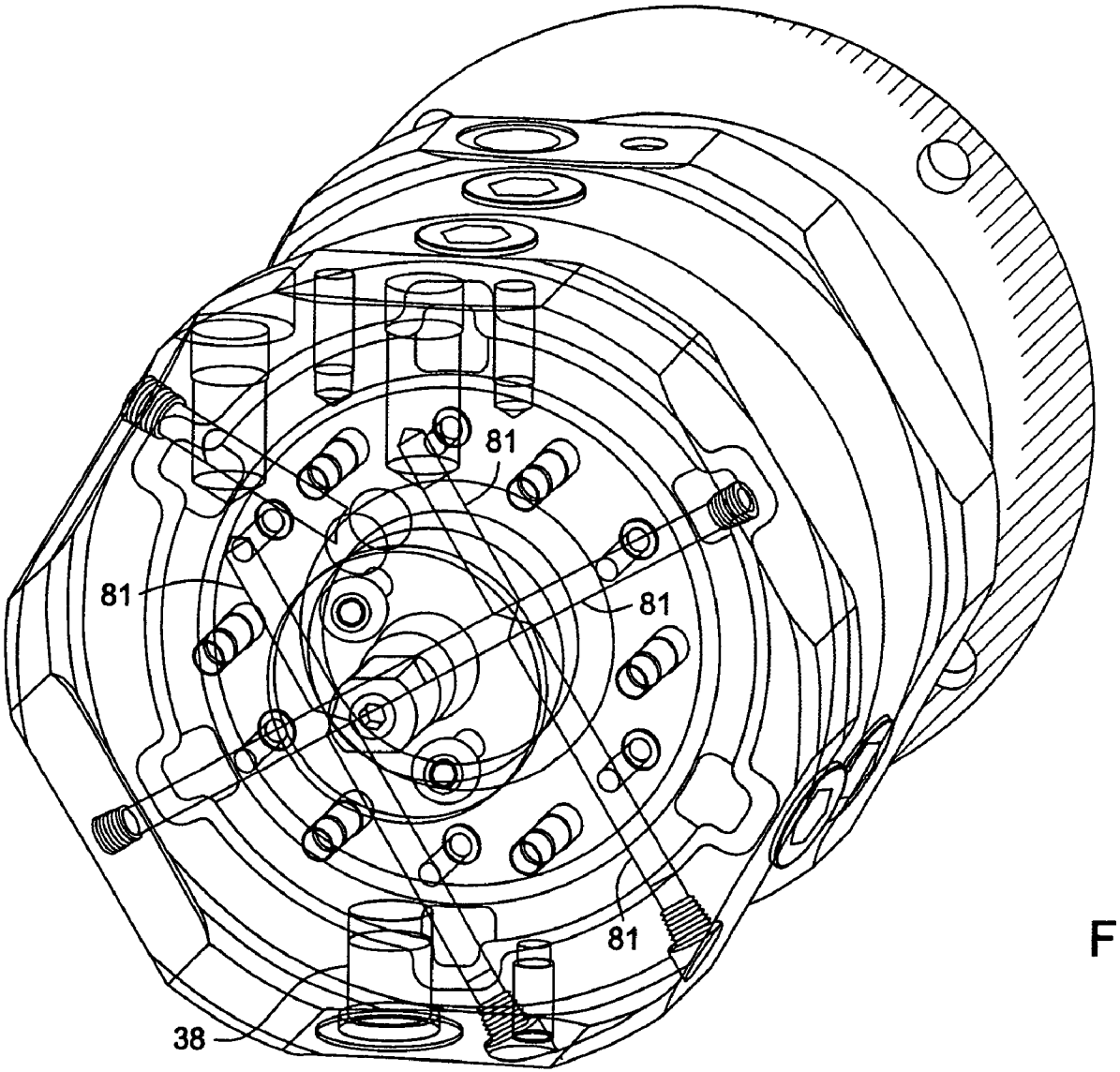
FIG. 9 illustrates another semi-transparent perspective view of the pump ring sub-assembly illustrated in FIG. 8.
Figure 10:
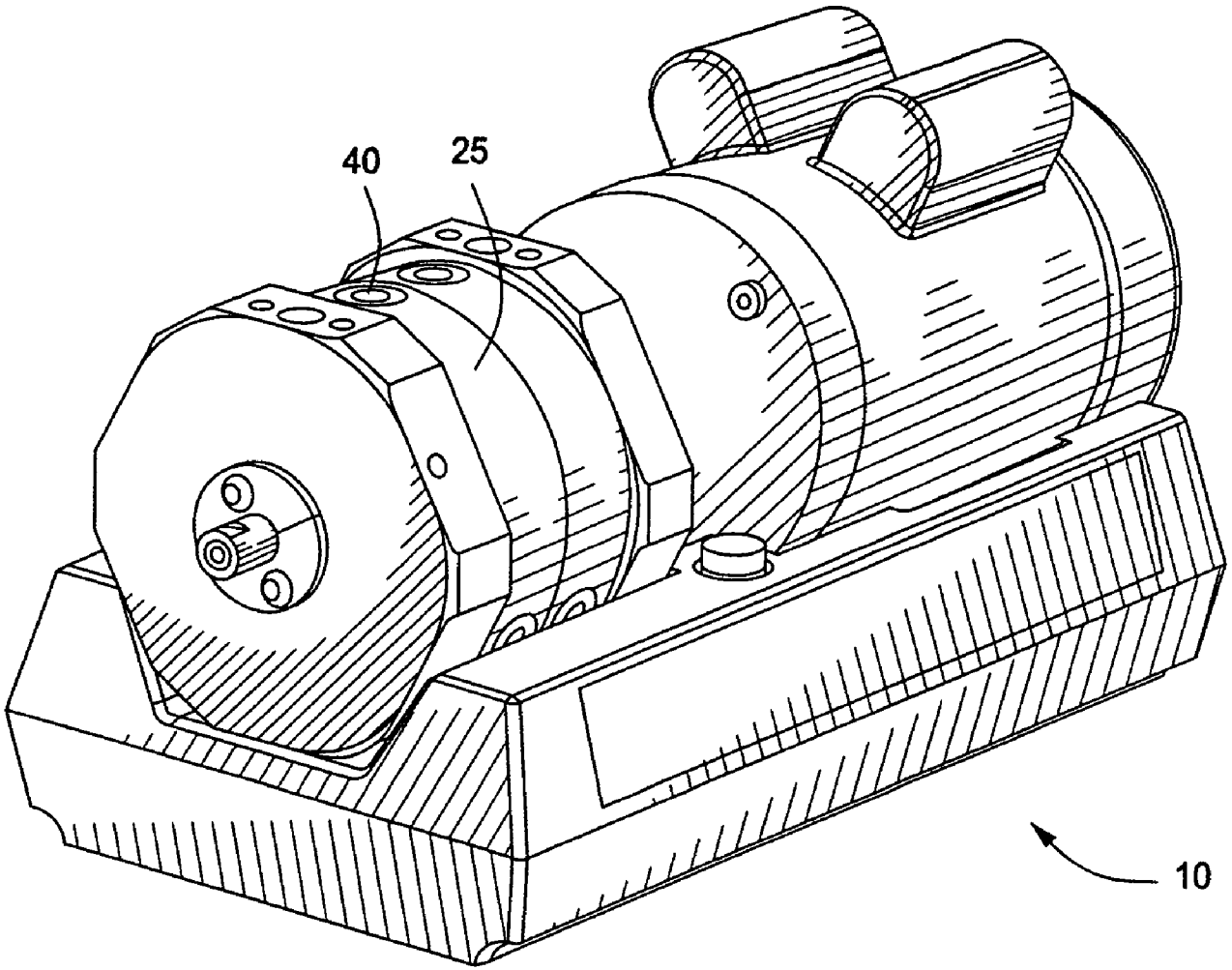
FIG. 10 illustrates a perspective view of a representative implementation of the pump illustrated in FIG. 1.

FIG. 9 illustrates another semi-transparent perspective view of the pump ring sub-assembly 25 illustrated in FIG. 8. After flowing into the high-pressure oil output groove 80 illustrated in FIG. 8, the oil typically flows through one of the output hole passages 94 illustrated in FIG. 8 and out toward the pump output port 40 (see FIG. 9) of the pump 10. The flow of this oil is typically through one of the channels 81 illustrated in FIG. 9. FIG. 10 illustrates a perspective view of a representative implementation of the pump 10 illustrated in FIG. 1.

One advantage of certain embodiments of the present invention is that the geometry discussed above minimizes the amount of dead volume in the pumping chamber 62 when the pistons 30 are fully stroked. In other words, the size of the pumping chamber 62 is minimized and, because oil is somewhat compressible, the fact that there is less oil present to compress maximizes the efficiency of the pump 10. Keeping the two output ports 40 small and close to the end stroke of the piston 30 minimizes the dead volume.

Yet another advantage of certain embodiments of the present invention has to do with the fact that the threaded nature of the cartridge 60 makes the cartridge 60 conveniently and completely removable from the pump 10. Since the check ball guide 68 may be designed to be easily removable from the cartridge 60 (e.g., by merely unsnapping one or more tabs), the guide 68 may also cost-effectively be repaired or replaced by another without having to interrupt the use of the pump for any extended length of time.

According to other embodiments of the present invention, a method of operating a piston such as, for example, piston cartridge 60, is provided. The method includes introducing a hydraulic fluid (e.g., oil) into a piston chamber (e.g., pumping chamber 62). The method also includes applying a force to the hydraulic fluid in the chamber using a piston. This step may be implemented, for example, by moving piston 30 in FIG. 6 to the left, thereby applying pressure to the oil in the pumping chamber 62.

In addition to the above, the method also may include releasing the hydraulic fluid from a plurality of outlet ports (e.g., ports 76), wherein at least one of the outlet ports remains substantially unblocked by the piston while the piston is applying force to the hydraulic fluid. In other words, when implementing this step using the cartridge 60, during operation, the stroke of the piston 30 does not totally block the output ports 76.

The method, according to certain embodiments of the present invention, also includes substantially sealing an outlet port in the plurality of outlet ports using a moveable obstruction (e.g., output check balls 74) upon the piston being moved away from the outlet port. The method may also include substantially surrounding the piston chamber using a retainer (e.g., C-spring 78). Then, the method may include using the retainer to prevent the moveable obstruction from completely detaching from the piston cartridge. In other words, the C-spring 78 may be used to keep the output check balls 74 from moving away from the cartridge upon the piston 30 moving to the left in FIG. 6.

The method may also include including a housing (illustrated as item 98 in FIG. 6) as part of the piston chamber. The method may also include providing a threaded portion (e.g., threaded portion 82) on the housing, thereby facilitating the housing being removed from the pump. In other words, because of the threads, the housing 98 of the cartridge 60 may be unscrewed and replaced with a new cartridge 60.

The above-discussed pump 10 and cartridges 60 may be implemented in a number of ways. For example, FIG. 9 illustrates a perspective view of a representative implementation of the pump 10 discussed above. FIG. 10 then illustrates another perspective view of the piston cartridge 60 illustrated in FIGS. 6 and 7. Finally, FIG. 11 illustrates another semi-transparent perspective view of the pump ring sub-assembly 25 illustrated in FIG. 8.

In addition to the above, the method may also include allowing the hydraulic fluid to enter the chamber through an inlet port (e.g., ports 64) and substantially sealing the inlet port upon the piston being moved toward the inlet port. Typically, this may be done using the suction check ball 66. Further, the method may include partially restricting motion of the moveable obstruction that substantially seals the inlet using protrusions. This step may be implemented using the check ball guide 68 and the lobes thereon 70. Lastly, the method may include allowing the hydraulic fluid to flow through channels in the moveable obstruction that substantially seals the inlet. This step may be implemented using the above-discussed grooves 80.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A piston cartridge, comprising:

a piston chamber;

an inlet port positioned adjacent to the piston chamber and providing a pathway through which a fluid may enter the piston chamber;

a first outlet port positioned adjacent to the piston chamber and providing a pathway though which the fluid may exit the piston chamber;

a piston at least partially positioned within the piston chamber and moveable between a first position that is relatively close to the inlet port and a second position that is relatively far from the inlet port;

a first barrier positioned between the piston and the inlet port;

a first sealing member positioned and moveable between the first barrier and the inlet port, wherein the first sealing member substantially seals the inlet port when positioned adjacent to the inlet port but allows the fluid into the piston chamber when positioned adjacent to the first barrier;

a second barrier being a C-spring positioned adjacent to the first outlet port; and a second sealing member positioned and moveable between the piston and the second barrier, wherein the second sealing member substantially seals the first outlet port when positioned adjacent thereto but allows the fluid to pass through the first outlet port when urged against to deform the second barrier.

2. The piston cartridge of claim 1, wherein the first sealing member includes a substantially spherical portion.

3. The piston cartridge of claim 1, wherein the second barrier is positioned outside of the piston chamber.

4. The piston cartridge of claim 1, further comprising:

a housing that includes the piston chamber; and a threaded portion on the housing that is configured to allow for the piston cartridge to be screwed onto a pump.

5. The piston cartridge of claim 4, further comprising:

a groove external to the housing that accommodates the second barrier therein.

6. The piston cartridge of claim 4, further comprising:

a groove external to the housing configured to guide the fluid flowing therein to a desired location.

7. The piston cartridge of claim 4, wherein the second barrier comprises a C-shaped spring positioned external to the housing.

8. The piston cartridge of claim 1, further comprising:

a second outlet port positioned adjacent to the piston chamber and providing another pathway though which the fluid may exit the piston chamber; and a third sealing member positioned and moveable between the piston and the second barrier, wherein the third sealing member substantially seals the second outlet port when positioned adjacent thereto but allows the fluid to pass through the second outlet port when positioned adjacent to the second barrier.

9. The piston cartridge of claim 1, further comprising a spring that applies a restorative force to the piston when the piston is at a location other than the second position.

10. A method of operating a piston, the method comprising:

moving the piston within a piston chamber from a first position that is relatively close to an inlet port of the piston chamber to a second position that is relatively far from the inlet port;

allowing a fluid to flow into the piston chamber upon moving the piston from the first position to the second position by allowing a first sealing member configured to seal the inlet port when positioned adjacent thereto to move away from the inlet port; and blocking an outlet by moving the second sealing number with a C-spring toward a seat when the piston moves from the first position to the second position.

11. The method of claim 10, further comprising:

moving the piston from the second position to the first position;

preventing the fluid from flowing into the piston chamber upon moving the piston from the second position to the first position by biasing the first sealing member toward the inlet port; and allowing the fluid to flow out of the piston chamber upon moving the piston from the second position to the first position by biasing the second sealing member away from the outlet port.

12. The method of claim 10, further comprising:

preventing the first sealing member from entering the piston chamber using a first barrier positioned between the inlet port and the piston chamber.

13. The method of claim 10, further comprising:

preventing the second sealing member from detaching from the piston chamber using a second barrier positioned between outside of the outlet port.

14. The method of claim 10, further comprising:

removing a piston cartridge assembly from a pump that the piston is operating in by unscrewing the piston cartridge assembly and thereby releasing threaded portions on an exterior portion of a housing that includes the piston chamber.

15. The method of claim 10, further comprising:

allowing the fluid to flow out of the piston chamber upon moving the piston from the second position to the first position by biasing a third sealing member away from a second outlet port connected to the piston chamber.

16. The method of claim 10, further comprising:

preventing the fluid from flowing out of the piston chamber upon moving the piston from the first position to the second position by allowing a third sealing member to move toward a second outlet port connected to the piston chamber and to thereby form a seal therewith.

17. A piston cartridge, comprising:

fluid accommodating means for accommodating a fluid;

fluid inletting means for inletting the fluid into the fluid accommodating means, wherein the fluid inletting means is positioned adjacent to the fluid accommodating means and provides a pathway through which the fluid may enter the fluid accommodating means;

fluid outletting means for outletting the fluid from the fluid accommodating means, wherein the fluid outletting means is positioned adjacent to the fluid accommodating means and providing a pathway though which the fluid may exit the fluid accommodating means;

fluid moving means for moving the fluid, wherein the fluid moving means is at least partially positioned within the fluid accommodating means and moveable between a first position that is relatively close to the fluid inletting means and a second position that is relatively far from the fluid inletting means;

first barrier means for providing a first barrier, the first barrier means positioned between the fluid moving means and the fluid inletting means;

first sealing means for providing a first fluid seal, the first sealing means positioned and moveable between the first barrier means and the fluid inletting means, wherein the first sealing means substantially seals the fluid inletting means when positioned adjacent to the fluid inletting means but allows the fluid into the fluid accommodating means when positioned adjacent to the first barrier means;

second barrier means including a C-spring for providing a second barrier, the second barrier means positioned adjacent to the fluid outletting means; and second sealing means positioned and moveable between the fluid moving means and the second barrier means, wherein the second sealing means substantially seals the fluid outletting means when positioned adjacent thereto but allows the fluid to pass through the fluid outletting means when positioned adjacent to the second barrier means.

18. The piston cartridge of claim 17, further comprising:

biasing means for biasing the fluid moving means toward the second position, wherein the biasing means is positioned adjacent to the fluid moving means.

19. The piston cartridge of claim 17, further comprising:

guiding means for guiding fluid flowing out of the fluid outletting means to a desired location that is external to the fluid accommodating means.

20. The piston cartridge of claim 17, further comprising:

restricting means for restricting sliding rotational motion of the second barrier means.

* * * * *